US009987841B2

(12) United States Patent
Torgerson et al.

(10) Patent No.: US 9,987,841 B2
(45) **Date of Patent: *Jun. 5, 2018**

(54) INKJET PRINT HEAD WITH SHARED DATA LINES

(71) Applicant: Hewlett-Packard Development Company, L.P., Houston, TX (US)

(72) Inventors: Joseph M. Torgerson, Philomath, OR (US); Trudy Benjamin, Portland, OR (US); Kevin Bruce, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/359,049

(22) Filed: Nov. 22, 2016

(65) Prior Publication Data

US 2017/0072687 A1 Mar. 16, 2017

Related U.S. Application Data

(63) Continuation of application No. 12/739,076, filed as application No. PCT/US2007/023991 on Nov. 14, 2007.

(51) Int. Cl.
*B41J 2/045* (2006.01)
*B41J 2/21* (2006.01)

(52) U.S. Cl.
CPC ..... *B41J 2/04541* (2013.01); *B41J 2/04501* (2013.01); *B41J 2/04586* (2013.01); *B41J 2/2103* (2013.01); *B41J 2202/13* (2013.01)

(58) Field of Classification Search
CPC ..... B41J 2/04541; B41J 2/04501; B41J 2/04586; B41J 2202/13; B41J 2/2103
See application file for complete search history.

(56) References Cited

U.S. PATENT DOCUMENTS

| | | | | |
|---|---|---|---|---|
| 5,363,134 | A | 11/1994 | Barbehenn et al. | |
| 5,757,394 | A | 5/1998 | Gibson et al. | |
| 5,956,052 | A | 9/1999 | Udagawa et al. | |
| 6,022,094 | A | 2/2000 | Gibson et al. | |
| 6,161,916 | A | 12/2000 | Gibson et al. | |
| 6,568,783 | B2 | 5/2003 | Hu et al. | |
| 6,631,967 | B1 | 10/2003 | Saruta | |
| 6,948,789 | B2 | 9/2005 | Imanaka et al. | |
| 7,075,674 | B2 | 7/2006 | Nagumo et al. | |
| 7,198,348 | B2 * | 4/2007 | Hu | B41J 2/17546 347/19 |
| 7,242,607 | B2 | 7/2007 | Kim | |
| 7,311,385 | B2 | 12/2007 | Edelen et al. | |
| 2002/0140751 | A1 | 10/2002 | Imanaka et al. | |

(Continued)

*Primary Examiner* — Manish S Shah
*Assistant Examiner* — Yaovi M Ameh
(74) *Attorney, Agent, or Firm* — Brooks, Cameron & Huebsch, PLLC

(57) ABSTRACT

An inkjet print head includes data signal lines configured to supply inkjet control voltages and non-volatile memory cell random access addresses. The inkjet print head includes an inkjet nozzle array wherein each nozzle in the array is configured to communicate with a data signal line. Also a non-volatile attribute memory cell array is included in the inkjet print head wherein each memory cell in the array is accessed through a data signal line shared with the nozzle array.

13 Claims, 3 Drawing Sheets

(56) References Cited

U.S. PATENT DOCUMENTS

| | | | | |
|---|---|---|---|---|
| 2004/0095409 | A1 | 5/2004 | Hu et al. | |
| 2005/0227826 | A1 | 10/2005 | Oga | |
| 2005/0231541 | A1 | 10/2005 | Benjamin | |
| 2006/0256160 | A1 | 11/2006 | Ozaki et al. | |
| 2007/0179656 | A1* | 8/2007 | Eshed | B29C 67/0059 700/119 |
| 2007/0188539 | A1 | 8/2007 | Saruta | |
| 2007/0236519 | A1* | 10/2007 | Edelen | B41J 2/04541 347/9 |
| 2010/0302293 | A1* | 12/2010 | Torgerson | B41J 2/04586 347/10 |

* cited by examiner

INKJET PRINT HEAD WITH SHARED DATA LINES

PRIORITY APPLICATION INFORMATION

This application is a continuation of U.S. application Ser. No. 12/739,076 filed Apr. 21, 2010, which is a national stage application under 35 § USC 371 of International Application No. PCT/US2007/023991, filed Nov. 14, 2007, all of which are incorporated by reference in their entirety.

BACKGROUND

One of the areas of continued progress of inkjet printing is that of print heads. Development is ongoing and is working towards improved print speeds, quality and resolution, versatility in handling different ink bases and viscosity, robustness of the print heads for industrial applications, and improved width of printing swathes. Manufacturers have reduced printer prices by incorporating much of the actual print head into the cartridge itself. The manufacturers believe that since the print head is the part of the printer that is most likely to wear out, replacing it every time the cartridge is replaced can increase the life of the printer.

Modern inkjet printing is performed with a self-contained print head that includes an ink reservoir, complete with inkwell, spraying mechanism, and nozzles that can be controlled accurately. An inkjet print head may contain nozzles or orifices for the ejection of printing fluid onto a printing medium. Nozzles are typically arranged in one or more arrays such that characters or images may be printed on a medium moving relative to the nozzle array. Print head attributes that may determine print head performance include ink drop volume, pen types, ink types, and column to column nozzle spacing. Data representing the inkjet attributes is stored with the print head and can be read by the inkjet printer during initialization.

DETAILED DESCRIPTION

In describing embodiments of the present invention, the following terminology will be used.

The singular forms "a," "an," and "the" include plural referents unless the context clearly dictates otherwise. Thus, for example, reference to "a device" includes reference to one or more of such devices.

As used herein, array parameters, shapes and other quantities and characteristics are not and need not be exact, but may be approximated and/or, larger or smaller, as desired, reflecting process tolerances, conversion factors, rounding off, measurement error and the like and other factors known to those of skill in the art.

Reference will now be made to the exemplary embodiments illustrated, and specific language will be used herein to describe the same. It will nevertheless be understood that no limitation of the scope of the invention is thereby intended.

Figure 1:
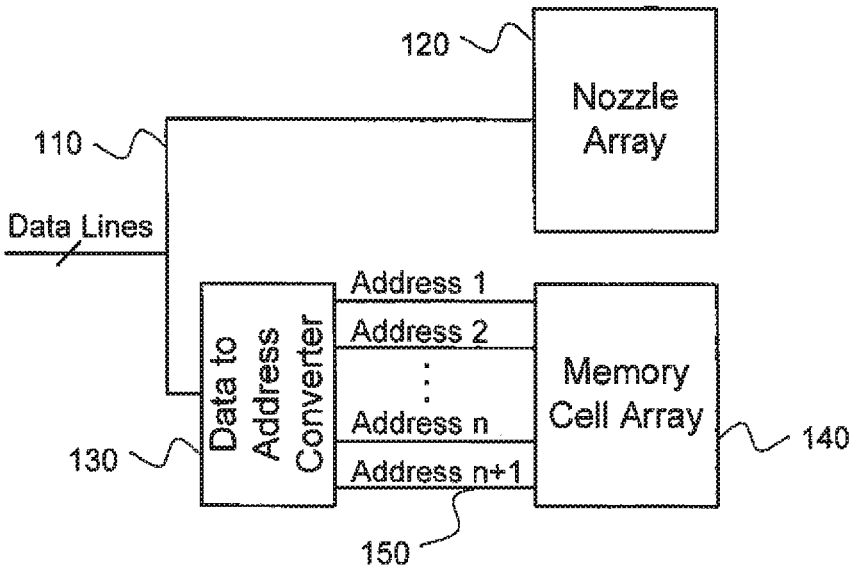
FIG. 1 depicts elements of an inkjet print head in accordance with an embodiment.

FIG. 1 illustrates an inkjet print head that includes a plurality of data signal lines 110 configured to supply inkjet control voltages to a nozzle array and to supply random access addresses to a non-volatile memory cell array. As a result, extra data signal lines are not needed for the memory cell array. The memory cell array may be used to store print head attributes such as column to column spacing, ink types, pen types, drop volume, ink availability, and other like attributes.

The fabrication of non-volatile memory cells typically uses in excess of 14 to 16 masks but the fabrication of a nozzle array may require fewer than half as many masks. Developing a process technology to fabricate both the nozzle array and the non-volatile memory array together in a single print head can be cost prohibitive. Additionally, where the nozzle array and the memory array are fabricated separately, providing interconnects between the two arrays increases costs in manufacturing and debugging.

Print heads which have devices that use fuses to store attributes require large silicon areas which may easily be visually examined to reverse engineer attribute data for cloning. The present disclosure inhibits cloning of print head attribute data by storing attribute data in non-volatile memory cells fabricated onto the same chip as the print head in a single fabrication technology with the nozzle arrays. Attribute data stored into non-volatile memory cells is less likely to be visually reverse engineered since the information is stored electronically on floating gates.

The inkjet nozzle array 120 includes a plurality of nozzles wherein each nozzle in the array is configured to communicate with a data signal line 110 which may control the nozzle through variable voltages. The non-volatile memory cell array 140 includes a plurality of memory cells wherein each memory cell in the array is accessed through the data signal line shared with the nozzle array. The non-volatile memory cell can be an EPROM (Electrically Programmable Read Only Memory). Flash memory or another type of non-volatile memory.

Only non-volatile memory cells of a chosen polarity need be programmed or written. Where a logical '1' is the chosen polarity of a programmed memory cell, logical '0' cells may remain unwritten. Thus only an address need be present at the memory cell array in order to write data to anon-volatile memory cell.

In an embodiment, an inkjet print head may further comprise a data to address converter 130 configured to convert data on a data signal line into a random access address on multiple random address lines 150 labeled 'Address 1', through 'Address n+1' in FIG. 1. A random access address, as opposed to a sequential access address, allows access to a memory cell independent of the cell access prior to or following the access of the cell at the random access address.

The data to address converter may further comprise a shift register configured to receive data from a data signal line connected to an input data pin. The data can be used for addressing the non-volatile attribute array. A data signal line may exist for every bit latched in the shift register. Every bit latched in the shift register becomes an address bit that may be applied to the memory array.

To improve efficiency, a second shift resister may be configured in an embodiment to receive data from a second data signal line connected to a second input data pin to enable addressing a second portion of the non-volatile attribute array. The more shift registers used in an embodiment, the less shifting of data is required to program the shift register and thus the converter becomes more efficient. In an alternate embodiment, the data to address converter may comprise transistor logic configured to generate a plurality of random access address lines. A single data line may generate two address lines by using Boolean true and complement line generation. Two address lines may generate four address lines by all possible combinations of the Boolean true and complement of the two address lines. Therefore, $2^N$ possible address lines may be generated where N is equal to the number of data lines entering the data to address converter.

In other embodiments, the non-volatile attribute memory cell array may further comprise 64 cells to 128 cells. An array may also be split into several physically discrete though logically adjacent smaller arrays to utilize existing space in the print head silicon. Arrays may be rectangular or square to fit die space requirements. One result of the present disclosure is that non-volatile memory arrays may be added to the print head without any increase in silicon area above that needed for the nozzle arrays and print head control.

Programming voltages may be generated off the print head and read currents may be sensed off the print head. Thus, support circuitry may be minimized for the memory cell array. Furthermore, the arrays are scalable to a larger number of memory cells by adding address lines for future advanced implementations.

An embodiment of the array may include multiple columns of NMOS (N-channel Metal Oxide Semiconductor) devices in series with a non-volatile n-channel memory device. Therefore, an inkjet print head may include only active devices characterized as NMOS devices with no PMOS (P-channel Metal Oxide Semiconductor) devices at all. Additionally, the non-volatile attribute memory cell array may include a covering over each attribute memory cell configured to prevent ultraviolet light erasure of the data stored on the non-volatile memory cell. However, erasure and programming of the array may be possible at wafer-sort prior to application of the cover.

Figure 2:
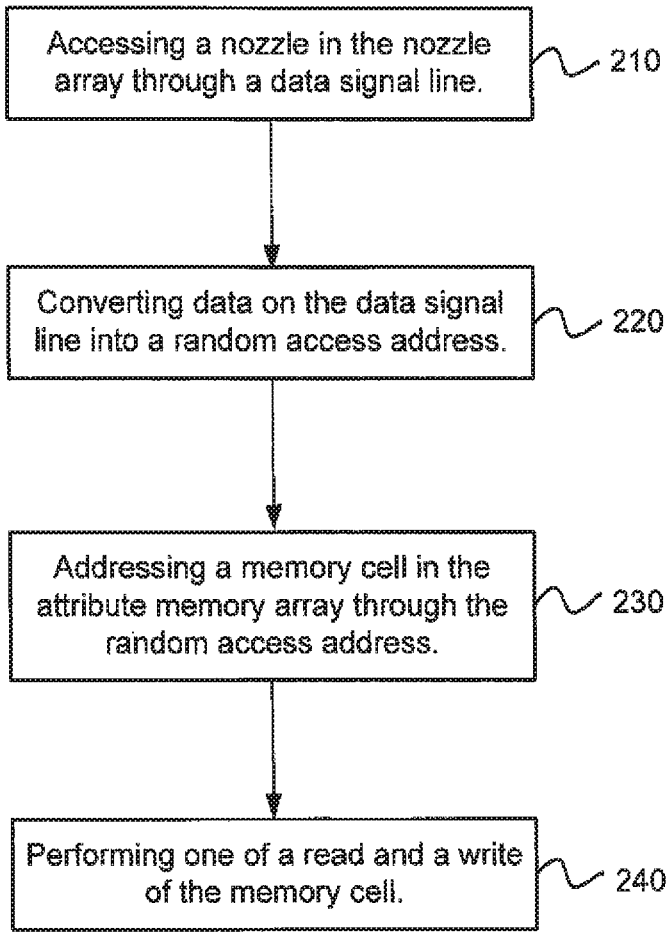
FIG. 2 depicts an embodiment of a method for using an inkjet print head having a nozzle array and a corresponding non-volatile memory cell array.

A method of using an inkjet print head having a nozzle array and a corresponding attribute non-volatile memory cell array will now be discussed. The method may include accessing a nozzle in the nozzle array through a data signal line as in step 210 depicted in FIG. 2. Data on the data signal line can be converted into a random access address as in step 220. Memory cells in the attribute memory array can be addressed through the random access address, as in step 230. A read or a write of the memory cell is performed as in step 240. The data signal line used to control a nozzle in the nozzle array is the same data signal line used to address a memory cell after the conversion of data to a random access address. One embodiment for sharing the data signal line between the nozzle array and the memory array includes latching data signals into a shift register wherein each latched signal has a corresponding signal line. The data signal lines from the shift register are applied to the memory cell array to access a memory cell at random for either a read or a write. Thus, the shift register effectively converts incoming data into a random access address. No data is necessary to address the nonvolatile memory array since the memory cell array only needs an address to program a binary '1' or a '0'.

An attribute memory cell can be read by sensing a voltage or a current from a column in the memory cell array associated with a memory cell on that column at a row address. Likewise an embodiment for writing an attribute memory cell includes driving a variable voltage pulse and a variable current source into a column associated with a data signal line and a memory cell. Reading and writing a memory cell may be done using support circuitry located on or off the print head.

Figure 3:
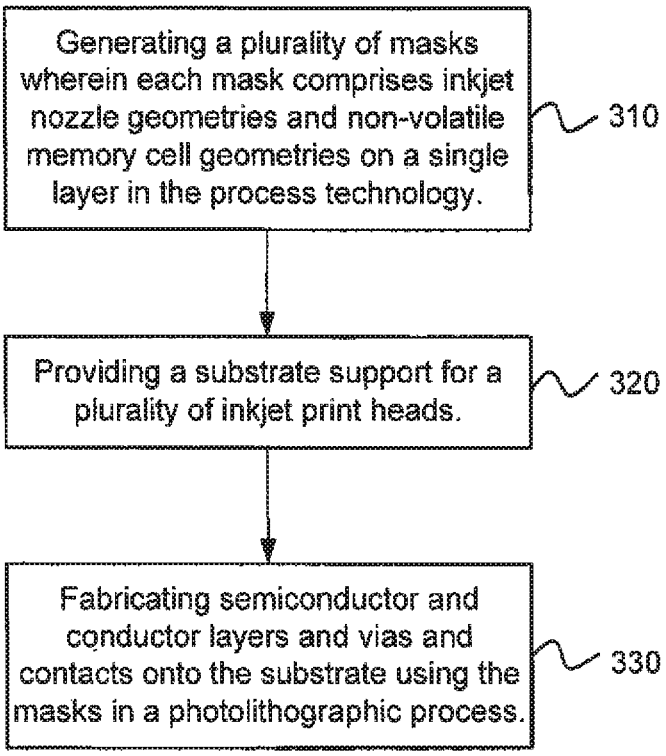
FIG. 3 depicts an embodiment of a method of making an inkjet print head in a single process technology.

A method of making an inkjet print head in a single process technology is depicted in FIG. 3. Masks are generated wherein each mask may comprise inkjet nozzle geometries and non-volatile memory cell geometries on a single layer in the process technology as in step 310. A substrate support is provided as in step 320 for the fabrication of multiple inkjet print heads as may be stepped on a single semiconductor wafer. A substrate may be cut from a silicon ingot, a glassy material, formed from a plastic, or a fabric material. Substrates provide a substantially flat surface on which to form the active semiconductor devices. The substrates used can be electrically non-conductive or may include an electrically non-conductive layer and may vary in thickness depending on the mechanical strength needed and the cost targeted in manufacturing. Semiconductor layers, conductor layers, associated vias and contacts can be fabricated onto the substrate as in step 330 using the masks in a photolithographic process.

An embodiment of a method of making an inkjet print head may further include generating masks having data signal lines shared between a nozzle array and a memory cell array. Since the fabrication technology for the non-volatile memory array has been optimized to the masks required for the nozzle array, fewer than 10 masks may be all that are needed to fabricate the memory cell array. A single process technology may include fabricating the semiconductor and conductor layers from a single master set of photolithographic masks configured to produce at least one complete print head.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A support circuitry to couple to an inkjet print head having a nozzle array, the support circuitry including:

a non-volatile memory cell array (NVMCA) including memory cells;

a data to address converter (DAC) coupled to the NVMCA, wherein the DAC further comprises logic to generate random access address signals, and wherein the DAC further comprises:

a first shift register to receive data from a first input data pin for a first data signal line and to address a first portion of the NVMCA; and a second shift register to receive data from a second input data pin for a second data signal line and to address a second portion of the NVMCA; and data signal lines, wherein each data signal line of the data signal lines is to be coupled to a nozzle included in the nozzle array and the DAC to supply nozzle control voltages to the nozzle and to supply non-volatile memory cell address data to address the NVMCA using a non-volatile memory cell address converted by the DAC from the non-volatile memory cell address data.

2. The support circuitry of claim 1, wherein the support circuitry is physically located off the inkjet print head and is to couple to the inkjet print head.

3. The support circuitry of claim 1, further comprising read support circuitry to read, via a data signal line of the data signal lines, inkjet print head data attributes stored in a memory cell of the NVMCA.

4. The support circuitry of claim 3, wherein the stored inkjet print head data attributes are selected from the group consisting of column to column spacing, ink types, pen types, drop volume, ink availability, and authentication data.

5. The support circuitry of claim 1, further comprising write support circuitry to write to a memory cell of the NVMCA.

6. The support circuitry of claim 5, wherein the data signal lines address cells of the NVMCA for writing to the memory cells of the NVMCA.

7. The support circuitry of claim 1, wherein the logic further comprises transistor logic to generate the random access address signals.

8. The support circuitry of claim 1, wherein the NVMCA further comprises 64 cells to 512 cells.

9. The support circuitry of claim 1, wherein the support circuitry further comprises a processor.

10. The support circuitry of claim 9, further comprising instructions executable by the processor to read, via a data signal line of the data signal lines, inkjet print head data attributes stored in a memory cell of the NVMCA.

11. The support circuitry of claim 1, wherein each memory cell in the NVMCA is to store data electronically in a floating gate of the NVMCA.

12. The support circuitry of claim 1, wherein the DAC is coupled via random access address lines to the NVMCA.

13. The support circuitry of claim 12, wherein a total number of the random access address lines is equal to $2^N$ wherein N is equal to a total number of the data signal lines.

* * * * *